US010155377B2

(12) United States Patent
Kodama et al.

(10) Patent No.: US 10,155,377 B2
(45) Date of Patent: Dec. 18, 2018

(54) MEDIUM TRANSPORTING MECHANISM

(71) Applicant: SEIKO EPSON CORPORATION, Tokyo (JP)

(72) Inventors: Hidetoshi Kodama, Nagano (JP); Akinori Muromachi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/916,345

(22) Filed: Mar. 9, 2018

(65) Prior Publication Data

US 2018/0194130 A1 Jul. 12, 2018

Related U.S. Application Data

(63) Continuation of application No. 15/407,540, filed on Jan. 17, 2017, now Pat. No. 9,925,763.

(30) Foreign Application Priority Data

Jan. 21, 2016 (JP) ..... 2016-009540
Jan. 13, 2017 (JP) ..... 2017-003963

(51) Int. Cl.

| | |
|---|---|
| ***B41J 3/60*** | (2006.01) |
| ***B41J 11/51*** | (2006.01) |
| ***B41J 2/005*** | (2006.01) |
| ***B41J 13/00*** | (2006.01) |

(52) U.S. Cl.
CPC ..... *B41J 2/0057* (2013.01); *B41J 13/0009* (2013.01)

(58) Field of Classification Search
CPC ... B41J 3/60; B41J 13/00; B41J 13/009; B41J 13/0045; B41J 11/51; B41J 11/0005; B41J 11/0015; B41J 11/42; B41J 11/0095; G03G 15/6576
See application file for complete search history.

(56) References Cited

U.S. PATENT DOCUMENTS

2006/0214974 A1* 9/2006 Isobe ..... B41J 29/377 347/18
2009/0051720 A1* 2/2009 Uchino ..... B41J 3/60 347/16
2015/0362875 A1* 12/2015 Ono ..... B65H 5/068 399/322

FOREIGN PATENT DOCUMENTS

JP 09-012198 A 1/1997
JP 2005-239363 A 9/2005
JP 2013-071833 A 4/2013

* cited by examiner

*Primary Examiner* — Geoffrey S Mruk
*Assistant Examiner* — Scott A Richmond

(57) ABSTRACT

The present invention relates to a print system, such as an ink jet printer, which performs printing on a medium, such as a sheet that is transported.

9 Claims, 7 Drawing Sheets

MEDIUM TRANSPORTING MECHANISM

CROSS REFERENCE TO RELATED APPLICATIONS

This application is a continuation application of U.S. patent application Ser. No. 15/407,540, filed on Jan. 17, 2017. This application claims priority to Japanese Application No. 2016-009540 filed on Jan. 21, 2016 and Japanese Application No. 2017-003963 filed on Jan. 13, 2017. The entire disclosures of Japanese Application Nos. 2016-009540 and 2017-003963 and U.S. patent application Ser. No. 15/407,540 are hereby incorporated herein by reference.

BACKGROUND

1. Technical Field

The present invention relates to a print system, such as an ink jet printer, which performs printing on a medium, such as a sheet that is transported.

2. Related Art

In the related art, as an example of a print apparatus, an image forming apparatus that records (prints) an image on a sheet (medium) that is transported is known. In addition, there is an image forming apparatus including a switchback mechanism (inversion unit) that inverts the sheet in the image forming apparatus (for example, JP-A-9-12198).

That is, the switchback mechanism includes a roller, and a sheet fed from an upstream side transport path (first transport path) is sent and inverted on a downstream side transport path (second transport path) by rotating and counter-rotating the roller.

In the image forming apparatus, two switchback mechanisms are provided; one roller is used as a roller that feeds the sheet to one switchback mechanism and another roller is used as a roller that sends the sheet from the other switchback mechanism. That is, when the roller rotates, the sheet is fed to the one switchback mechanism and the sheet is sent from the other switchback mechanism. When the roller counter-rotates, the sheet is sent from the one switchback mechanism and the sheet is fed to the other switchback mechanism.

Therefore, the roller sends the sheet from the switchback mechanism to the downstream side transport path at the same speed as a speed for feeding the sheet from the upstream side transport path to the switchback mechanism.

However, for example, when printing is performed by adhering liquid such as ink to a surface of a sheet, there is a case where curling of the sheet such as curving of the sheet occurs. Curling is considered to occur due to a difference in the expansion rates between a swollen portion of a front surface permeated by the adhered liquid and a rear surface not permeated by the liquid such as the ink. The curling due to the liquid permeating a rear surface or the liquid evaporating gradually decreases over time following the adhering of the liquid to the sheet.

In addition, the shape of the sheet caused to swell by absorbing the liquid is fixed in accordance with the evaporation and drying of the liquid. That is, for example, when the sheet dries while transport of the sheet is stopped, the sheet is fixed in the shape of a transport path. Therefore, it is preferable that the shape be changed by transporting the sheet until the adhered liquid dries.

In the case of the image forming apparatus of JP-A-9-12198, the speed for sending the sheet from the switchback mechanism is determined in accordance with the speed for feeding the sheet to the switchback mechanism. Therefore, there is a problem that the transport path of the sheet is increased to increase the transport time such that the size of the apparatus increases.

The problem is not limited to the image forming apparatus that performs recording on a sheet, but is common to print apparatuses that print on a medium.

SUMMARY

An advantage of some aspects of the invention is to provide a print apparatus capable of ensuring a required transport time while suppressing an increase in the size of the apparatus.

Hereinafter, units for solving the problem and effects thereof will be described.

According to an aspect of the invention, there is provided a print system including: a print apparatus including a printing unit that prints by adhering liquid to a medium, and an upstream side transport path that transports the medium printed on by the printing unit; an intermediate device including an intermediate transport path along which the medium is transported from the upstream side transport path, the intermediate transport path having a switchback path that switches back the medium, an inversion path that inverts the medium transported from the switchback path, and a post-inversion path that transports the medium inverted by the inversion path; and a post-processing device including a downstream side transport path along which the medium is transported from the intermediate transport path, a post-processing unit that performs post-processing on the medium transported from the downstream side transport path, and a discharge unit that discharges the medium on which the post-processing is performed by the post-processing unit, in which a second transport speed that is a transport speed of the medium on the post-inversion path is slower than a first transport speed that is the transport speed of the medium on the upstream side transport path, and in which a distance between a trailing end of a preceding medium and a leading end of a subsequent medium following the preceding medium during a period required for transporting the preceding medium at the second transport speed is less than that during a period required for transporting the preceding medium at the first transport speed.

According to the configuration, before inversion is performed, a medium is transported at a first transport speed, and after inversion is performed, the medium is transported at a second transport speed slower than the first transport speed. Therefore, a time required for transporting along the second transport path can be longer than a time required in a case where transporting is performed at a first transport speed along the second transport path. Accordingly, it is possible to ensure a required transport time while suppressing an increase in the size of an apparatus. In addition, by decreasing intervals between media before inversion is performed according to a reduction in a transport speed of the medium after the inversion is performed, it is possible to suppress unintentional contact between media.

The print system may further include a transport control unit that controls transporting of the medium. In the print system, it is preferable that the print apparatus include a sheet cassette in which the medium is placed and a feeding unit that feeds the medium from the sheet cassette, with the transport control unit controlling the feeding unit to cause a first interval as an interval between the preceding medium and the subsequent medium in a case where the unit adhesion amount, which is an amount of liquid which is caused by the printing unit to adhere to the medium per unit area of the medium, is less than a threshold value set in advance, controlling the feeding unit to cause a second interval larger than the first interval as the interval between the preceding medium and the subsequent medium in a case where the unit adhesion amount is greater than the threshold value, controlling the transport speed to be the second transport speed in a case where the interval between the preceding medium and the subsequent medium is the first interval, and controlling the transport speed to be a fourth transport speed slower than the second transport speed in a case where the interval between the preceding medium and the subsequent medium is the second interval, as the transport speed of the medium on the post-inversion path.

According to the configuration, as the unit adhesion amount increases, the required transport time increases. Furthermore, as the transport speed of the medium decreases, intervals between media decrease. According to the configuration, the interval between the media at the time of feeding is changed in accordance with the unit adhesion amount. Therefore, even in a case where the unit adhesion amount is high, by increasing the intervals between media in advance, it is possible to suppress the occurrence of contamination or the like due to overlapping of media even though a medium is transported at a sufficiently slow transport speed. In addition, in a case where a medium having a high unit adhesion amount and a large required transport time is transported, the medium is transported at a fourth transport speed slower than a second transport speed along the post-inversion path. Therefore, it is possible to further increase a time required for transporting the medium along the post-inversion path, compared with a case where the medium is transported at the second transport speed.

In the print system, it is preferable that the transport control unit control the transport speed of the medium to be a third transport speed faster than the second transport speed on the downstream side transport path.

In the post-processing unit performing a process on the medium, for example, when intervals between a plurality of media to be transported decrease, there is a possibility that the next medium will be transported before completing processing of the medium that is transported in advance such that erroneous processing is performed. According to the configuration, the medium is transported at a third transport speed faster than the second transport speed on the downstream side transport path. Therefore, even in a case where the intervals between the media decrease while being transported along the post-inversion path, since it is possible to increase the intervals between the media, it is possible to appropriately perform a process in the post-processing unit.

In the print system, it is preferable that the transport control unit control the transporting to cause an interval after which each of the media is switched back, the interval being smaller than an interval before which each of the media is switched back, as the interval between the preceding medium and the subsequent medium, and control the transporting to cause an interval larger than the interval after which the media is switched back when the preceding medium is transported at the third transport speed.

According to the configuration, it is possible to promote drying of the medium on an intermediate transport path, and it is possible to ensure an interval between media for appropriately performing post-processing in the post-processing unit.

In the print system, it is preferable that a plurality of pairs of the switchback path and the inversion path be provided on the intermediate transport path, that the plurality of the inversion paths be joined on the post-inversion path, and that the transport speed of the medium on the post-inversion path become the second transport speed or the fourth transport speed.

In the print system, it is preferable that the transporting be performed in a state where an upstream end of the preceding medium and a downstream end of the subsequent medium are separated from each other on the upstream side transport path, that the transporting be performed in a state where the upstream end of the preceding medium and the downstream end of the subsequent medium overlap each other on the post-inversion path, and the upstream end and the downstream end be separated from each other again, after the preceding medium reaches the third transport speed, on the downstream side transport path.

According to the configuration, since it is possible to separate the media from each other on a downstream side transport path while increasing transport efficiency of the medium on the post-inversion path, it is possible to appropriately perform the post-processing in the post-processing unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a print apparatus will be described with reference to the drawings.

Figure 1:
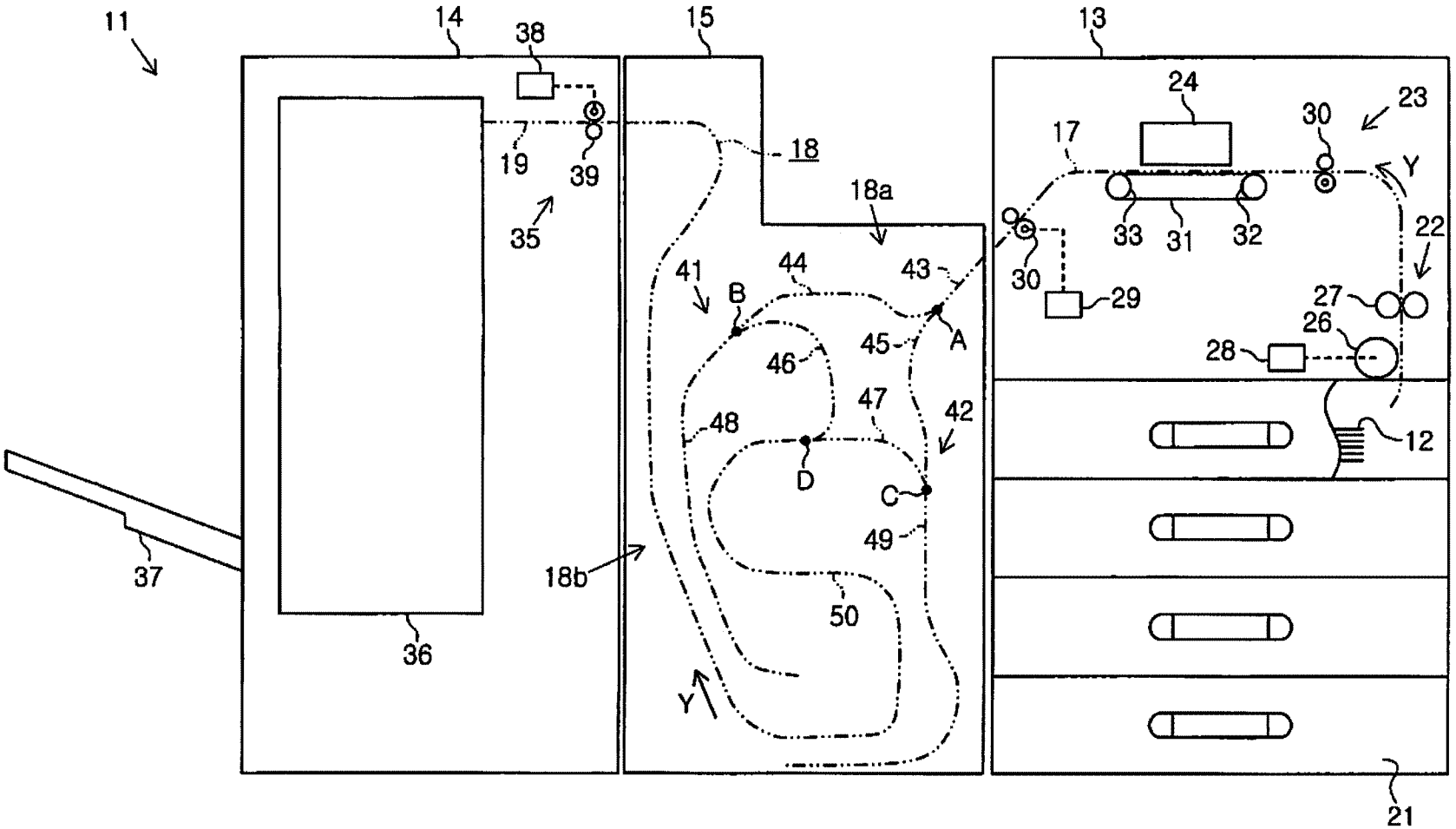
FIG. 1 is a schematic diagram of an embodiment of a print apparatus.

As described in FIG. 1, a print apparatus 11 includes a device main body 13 that is an example of a first device such as a printer performing printing on a medium 12 such as a sheet, a post-processing device 14 that is an example of a second device performing a process on the printed medium 12, and an intermediate device 15 that is an example of a third device positioned between the device main body 13 and the post-processing device 14.

An upstream side transport path 17 is provided in the device main body 13, and an intermediate transport path 18 is provided in the intermediate device 15. Furthermore, a downstream side transport path 19 is provided in the post-processing device 14. A transport path denoted by a two-dot chain in FIG. 1 is constituted by the upstream side transport path 17, the intermediate transport path 18, and the downstream side transport path 19 from the device main body 13 that is on an upstream side in the transport direction Y to the post-processing device 14 through the intermediate device 15.

At least one cassette 21 (four cassettes are shown in FIG. 1) capable of accommodating the medium 12 in a stacked state is detachably provided in the device main body 13. The device main body 13 includes a feeding unit 22 that feeds the medium 12 accommodated in the cassette 21, an upstream side transport unit 23 that transports the fed medium 12, and a printing unit 24 that prints on the medium 12 transported by the upstream side transport unit 23.

The feeding unit 22 includes a pickup roller 26 that sends the top medium 12 among the media 12 disposed in a stacked state on the cassette 21 and includes a separate roller pair 27 that separates the media 12 sent by the pickup roller 26 one at a time. Furthermore, the feeding unit 22 includes a feeding motor 28 for rotatably driving the pickup roller 26.

The upstream side transport unit 23 includes at least one upstream side transport roller pair 30 (two pairs are shown in FIG. 1) that transport the medium 12 along the upstream side transport path 17 by rotating in accordance with driving of an upstream side transport motor 29. Furthermore, a driving pulley 32 and a driven pulley 33 around which an endless transport belt 31 is wound are provided at a position along the upstream side transport path 17. The medium 12 is transported in accordance with rotation of a transport belt 31 in a state of being electrostatically attracted to a supporting surface (outer peripheral surface) of the transport belt 31.

The printing unit 24 is provided at a position facing the transport belt 31 with the upstream side transport path 17 interposed therebetween. The printing unit 24 performs printing by adhering liquid to the medium 12 transported by the upstream side transport unit 23 by ejecting the liquid such as ink onto the medium 12 transported by being supported by the transport belt 31. The printing unit 24 of the embodiment is a so-called line head capable of ejecting the ink at the same time in a width direction intersecting (for example, orthogonal to) the transport direction Y of the medium 12.

In addition, the post-processing device 14 includes a downstream side transport unit 35 that transports the medium 12 along the downstream side transport path 19, a post-processing unit 36 that performs a process on the medium 12 transported along the downstream side transport path 19, and a discharge unit 37 that discharges the processed medium 12.

The downstream side transport unit 35 includes at least one downstream side transport roller pair 39 (one pair is shown in FIG. 1) that transports the medium 12 along the downstream side transport path 19 by rotating in accordance with driving of a downstream side transport motor 38. For example, the post-processing unit 36 performs a process of stapling a plurality of media 12 with a staple (pin).

Next, the intermediate device 15 will be described.

As described in FIG. 1, the intermediate device 15 includes at least one inversion unit (two units of first inversion unit 41 and second inversion unit 42 in this embodiment) that inverts the transported medium 12. That is, the first inversion unit 41 and the second inversion unit 42 are disposed on the downstream side of the printing unit 24 in the transport direction Y of the transport path and invert the printed medium 12.

In addition, the intermediate transport path 18 includes an introduction path 43 of which an upstream end is connected to the upstream side transport path 17, and a first branch path 44 and a second branch path 45 which branch at a branch point A that is a downstream end of the introduction path 43. That is, the downstream end of the introduction path 43, an upstream end of the first branch path 44, and an upstream end of the second branch path 45 are connected to the branch point A. The introduction path 43 is formed in an approximately straight line, but the first branch path 44 and the second branch path 45 are curved to meander. The path length of the first branch path 44 and the path length of the second branch path 45 in the transport direction Y are approximately the same as each other.

Furthermore, the intermediate transport path 18 includes a first inversion path 46 connected to a first connection point B that is a downstream end of the first branch path 44, and a second inversion path 47 connected to a second connection point C that is a downstream end of the second branch path 45. The path length of the first inversion path 46 and the path length of the second inversion path 47 in the transport direction Y are approximately the same as each other.

In addition, a first switchback path 48 included in the first inversion unit 41 is connected to the first connection point B, and a second switchback path 49 included in the second inversion unit 42 is connected to the second connection point C. That is, the downstream end of the first branch path 44, an upstream end of the first inversion path 46, and a one end of the first switchback path 48 are connected to the first connection point B. In addition, the downstream end of the second branch path 45, an upstream end of the second inversion path 47, and a one end of the second switchback path 49 are connected to the second connection point C. The path length of the first switchback path 48 and the path length of the second switchback path 49 are configured to be equal to or greater than a length of the medium 12 which can be printed on by the device main body 13 in the transport direction Y.

Furthermore, the intermediate transport path 18 includes a derivation path 50 connected to a join point D at which the first inversion path 46 and the second inversion path 47 join. That is, a downstream end of the first inversion path 46, a downstream end of the second inversion path 47, and an upstream end of the derivation path 50 are connected to the join point D.

After the derivation path 50 curves and extends downward to meander between the first switchback path 48 and the second switchback path 49 toward the post-processing device 14, the derivation path 50 extends upward by bypassing the other end side of the first switchback path 48. A downstream end of the derivation path 50 is connected to the downstream side transport path 19 of the post-processing device 14.

In the embodiment, a pre-inversion path 18*a* is constituted by the introduction path 43, the first branch path 44, and the second branch path 45, and a post-inversion path 18*b* is constituted by the first inversion path 46, the second inversion path 47, and the derivation path 50. The pre-inversion path 18*a* is an example of a first transport path positioned on the upstream side of the first inversion unit 41 or the second inversion unit 42 in the transport direction Y. Furthermore, the post-inversion path 18*b* is an example of a second transport path positioned on the downstream side of the first inversion unit 41 or the second inversion unit 42 in the transport direction Y. That is, the intermediate transport path 18 includes the pre-inversion path 18*a* positioned at the upstream side in the transport direction Y and the post-inversion path 18*b* positioned on the downstream side of the first inversion unit 41 and the second inversion unit 42 in the transport direction Y. The downstream side transport path 19 is an example of a third transport path positioned on the downstream side f the post-inversion path 18*b* in the transport direction Y.

Figure 2:
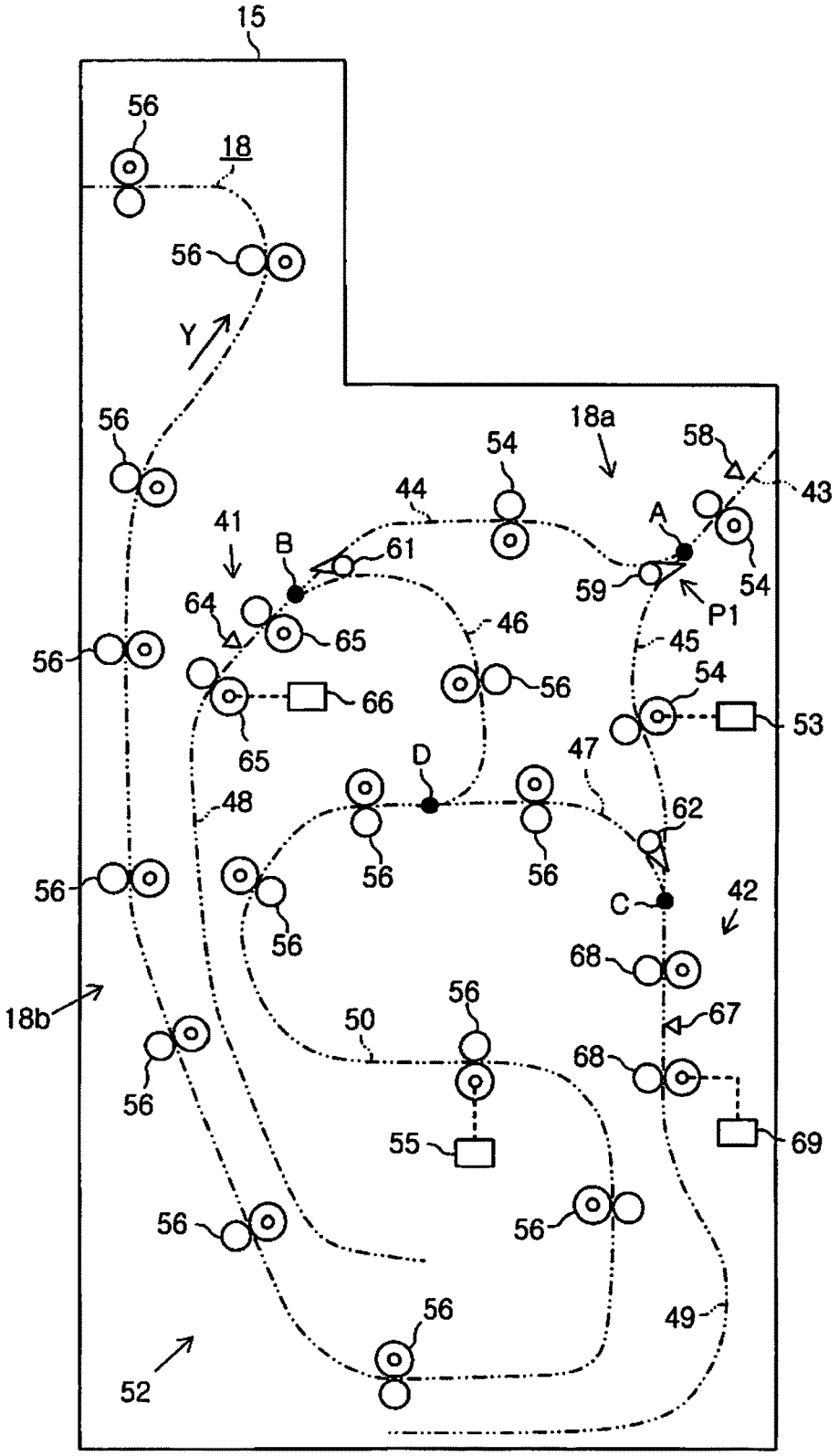
FIG. 2 is a schematic diagram of an intermediate device.

As described in FIG. 2, the intermediate device 15 includes an intermediate transport unit 52 that transports the medium 12 along the intermediate transport path 18. That is, the first inversion unit 41 and the second inversion unit 42 invert the medium 12 transported by the intermediate transport unit 52.

The intermediate transport unit 52 includes a first transport roller pair 54 driven by a first transport motor 53 and a second transport roller pair 56 driven by a second transport motor 55. A plurality of the first transport roller pairs 54 (three pairs are shown in FIG. 2) are provided on the pre-inversion path 18*a*, and a plurality of the second transport roller pairs 56 (14 pairs are shown in FIG. 2) are provided on the post-inversion path 18*b*.

In the print apparatus 11, a transport unit that transports the medium 12 from the upstream side to the downstream side in the transport direction Y along the transport path is configured by the upstream side transport unit 23, the downstream side transport unit 35, and the intermediate transport unit 52. That is, the transport unit transports the medium 12 along the transport path by rotatably driving one roller (drive roller shown by double circles in FIG. 1 and FIG. 2), in a state where each roller pair supports the medium 12 by interposing the medium 12 between leading and trailing sides thereof.

In addition, an introduction sensor 58 that detects the medium 12 is provided on the introduction path 43, and a guide flap 59 is provided at the branch point A of a downstream side of the introduction sensor 58. The guide flap 59 is driven by a solenoid (see FIG. 3) 60, and switches to guide the medium 12 transported along the introduction path 43 to one of the first branch path 44 and the second branch path 45. That is, the guide flap 59 switches positions between a first position P1 that guides the medium 12 to the first branch path 44, and a second position P2 (see FIG. 5) that guides the medium 12 to the second branch path 45.

Furthermore, a first regulation flap 61 that permits movement of the medium 12 from the first branch path 44 to the first switchback path 48, and regulates the movement of the medium 12 from the first switchback path 48 to the first branch path 44 in the downstream end of the first branch path 44. Furthermore, a second regulation flap 62 that permits the movement of the medium 12 from the second branch path 45 to the second switchback path 49, and regulates the movement of the medium 12 from the second switchback path 49 to the second branch path 45 in the downstream end of the second branch path 45. The first regulation flap 61 and the second regulation flap 62 are biased to close the downstream end of the first branch path 44 or the second branch path 45 by a bias force of a bias member (not shown).

The first inversion unit 41 includes a first inversion sensor 64 that detects the medium 12 fed to the first switchback path 48, and a plurality of first inversion roller pairs 65 (two pairs are shown in FIG. 1) that are provided at both sides of the first inversion sensor 64. The first inversion roller pairs 65 are driven in a rotation state or a counter-rotation state by a first inversion motor 66 based on a signal that is transmitted at the time of detecting the medium 12 by the first inversion sensor 64.

In addition, the second inversion unit 42 includes a second inversion sensor 67 that detects the medium 12 fed to the second switchback path 49, and a plurality of second inversion roller pairs 68 (two pairs are shown in FIG. 1) that are provided at both sides of the second inversion sensor 67. The second inversion roller pair 68 are driven in the rotation state or the counter-rotation state by a second inversion motor 69 based on a signal that is transmitted at the time of detecting the medium 12 by the second inversion sensor 67.

Figure 3:
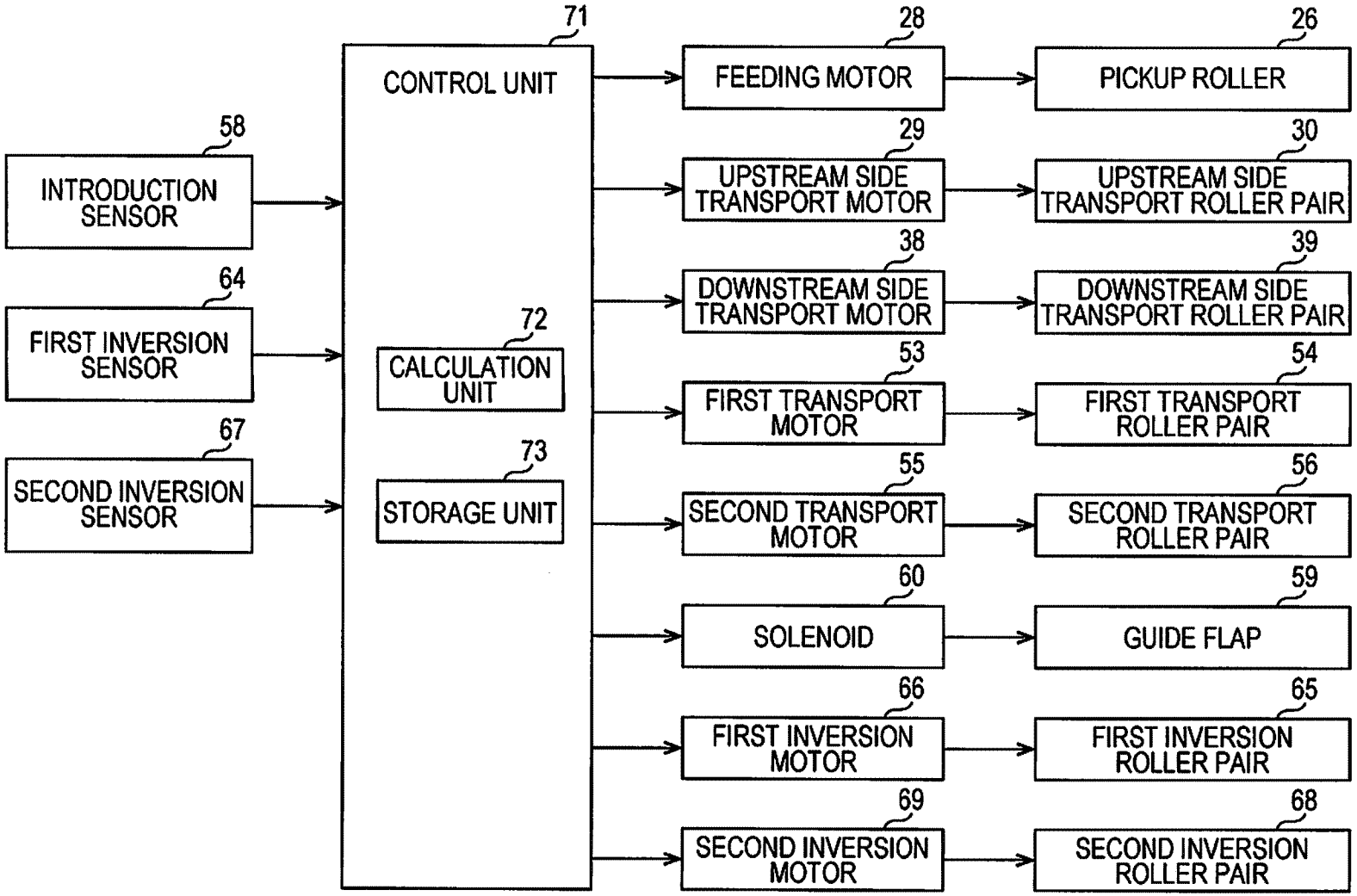
FIG. 3 is a block diagram of a control unit.

As described in FIG. 3, the print apparatus 11 includes a control unit 71 that collectively controls driving of each mechanism in the print apparatus 11. The control unit 71 transports the medium 12 to the upstream side transport unit 23, the intermediate transport unit 52, and the downstream side transport unit 35 by controlling driving of various motors and a solenoid 60 based on a detection result of the introduction sensor 58, the first inversion sensor 64, and the second inversion sensor 67.

In addition, the control unit 71 includes a calculation unit 72 that calculates a unit adhesion amount that is an amount of liquid which adheres per unit area of the medium 12 by the printing unit 24 based on print data, and a storage unit 73 that stores a threshold value relating to a predetermined unit adhesion amount. That is, the calculation unit 72 calculates the unit adhesion amount based on the print data when the print data is input to the print apparatus 11.

The threshold value is set according to a type of the medium 12 and liquid, a length of the transport path, and the like. That is, when the printing unit 24 performs printing by adhering the liquid to a front surface (print surface) of the medium 12, there is a case where curling in which the front surface has a convex shape occurs. Since a front surface side absorbing the liquid swells, but a rear side to which the liquid does not permeate does not swell, it is considered that the curling occurs due to a difference of expansion rates between the front and rear surfaces. Therefore, as the unit adhesion amount is high, the curling easily occurs. The liquid that adheres to the front surface permeates to the rear surface side or the liquid evaporates such that the curling is reduced in accordance with reduction of the swell on the front surface side.

Accordingly, for example, in a case of the medium to which the liquid easily permeates, a time required for reducing the curling is shorter than that of the medium to which the liquid is difficult to permeate. The threshold value is set by a small value as the medium to which the liquid is difficult to permeate, and the liquid is difficult to permeate and evaporate.

Next, a feeding interval of the medium 12 by the feeding unit 22, and a transport speed for transporting the medium 12 by the upstream side transport unit 23, the intermediate transport unit 52, and the downstream side transport unit 35 will be described. In a case where the unit adhesion amount calculated by the calculation unit 72 is less than the threshold value stored in the storage unit 73, the feeding unit 22 feeds the media 12 with a first interval, and in a case where the unit adhesion amount is greater than the threshold value, the feeding unit 22 feeds the media 12 with a second interval larger than the first interval.

Here, the transport speed may be a maximum transport speed during a section of a predetermined transport path, and may be an average transport speed during a section of a predetermined transport path. In addition, in a case where the media 12 are continuously transported, a case of speed of all of the media 12 is represented. However, even though it is a short period, there is also a case where the preceding medium 12 is slower than the subsequent medium 12. For example, when a switchback path is considered as a boundary, there is a moment where the preceding medium 12 is slower than the subsequent medium 12. Therefore, in a case where speeds of the preceding medium 12 and the subsequent medium 12 are compared with each other, it is necessary to check whether before or after the medium 12 is switched back. Here, for example, the section of a predetermined transport path is a section defined by a certain start point and a certain end point within the upstream side transport path 17 on the upstream side transport path 17, a section defined by a certain start point and a certain end point within the intermediate transport path 18 on the intermediate transport path 18, and a section defined by a certain start point and a certain end point within the downstream side transport path 19 on the downstream side transport path 19. Furthermore, a section defined by a certain start point within the upstream side transport path 17 and a certain end point within the intermediate transport path 18, may be set, and a section defined by a certain start point within the intermediate transport path 18 and a certain end point on the downstream side transport path 19, may be set. Furthermore, a section defined by a certain upstream start point from the switchback paths 48 and 49 and a certain downstream end point from the switchback paths 48 and 49, may be set on the intermediate transport path 18.

The first interval and the second interval are intervals of the media 12 in the transport direction Y. That is, for example, a time from feeding of the first medium to feeding of the second medium is set as a second interval time larger than a first interval time such that it is possible to set intervals between the media 12 with the second interval larger than the first interval.

The upstream side transport unit 23 transports the fed medium 12 at a pre-inversion speed (example of first transport speed) along the upstream side transport path 17. Furthermore, the intermediate transport unit 52 transports the medium 12 at the pre-inversion speed along the pre-inversion path 18*a*, and transports the medium 12 at the post-inversion speed slower than the pre-inversion speed along the post-inversion path 18*b*. Furthermore, the downstream side transport unit 35 transports the medium 12 along the downstream side transport path 19 at a processing speed (example of third transport speed) faster than the post-inversion speed.

The intermediate transport unit 52 changes the post-inversion speed according to the unit adhesion amount calculated by the calculation unit 72. That is, in a case where the unit adhesion amount is less than the threshold value stored in the storage unit 73, the intermediate transport unit 52 transports the medium 12 along the post-inversion path 18*b* at a first post-inversion speed (example of second transport speed). In a case where the unit adhesion amount is greater than the threshold value stored in the storage unit 73, the intermediate transport unit 52 transports the medium 12 along the post-inversion path 18*b* at a second post-inversion speed (example of fourth transport speed) slower than the first post-inversion speed.

That is, the medium 12 fed with an interval in accordance with the adhesion amount is transported at the pre-inversion speed along the upstream side transport path 17 and the pre-inversion path 18*a* regardless of the unit adhesion amount, and transported at the processing speed along the downstream side transport path 19. In the post-inversion path 18*b*, the medium 12 fed with the first interval is transported at the first post-inversion speed, and the medium 12 fed with the second interval is transported at the second post-inversion speed.

Among the pre-inversion speed, the first post-inversion speed, the second post-inversion speed, and the processing speed, the processing speed is fastest. The processing speed is approximately the same as the pre-inversion speed, or is a speed slower than the pre-inversion speed. The first post-inversion speed is slower than the pre-inversion speed, and the second post-inversion speed is slower than the first post-inversion speed (processing speed≥the pre-inversion speed>first post-inversion speed>second post-inversion speed). The transport speed of the medium 12 may satisfy the above-described inequality, the medium 12 may be transported at a constant speed in a section of a predetermined transport path, or the medium 12 may be transported while accelerating or decelerating.

Next, an operation in a case where the print apparatus 11 performs printing will be described.

In the following description, the media from the first sheet among the media 12 that are fed and transported to the feeding unit 22 are sequentially described as the first medium 12*a*, the second medium 12*b*, and the third medium 12*c*, and the fourth medium 12 is described as the fourth medium 12*d*.

When the printing is performed, the control unit 71 controls driving of the feeding motor 28 and the second transport motor 55 according to whether or not the calculated unit adhesion amount is greater than the threshold value stored in the storage unit 73. Furthermore, the control unit 71 drives the upstream side transport motor 29, the first transport motor 53, the first inversion motor 66, the second inversion motor 69, and the downstream side transport motor 38 in the rotation state.

That is, the medium 12 is fed by the feeding unit 22, and transported by the transport unit. In addition, the printing unit 24 performs the printing by ejecting the liquid on the medium 12 at a timing at which the medium 12 passes through between the printing unit 24 and the transport belt 31.

Figure 4:
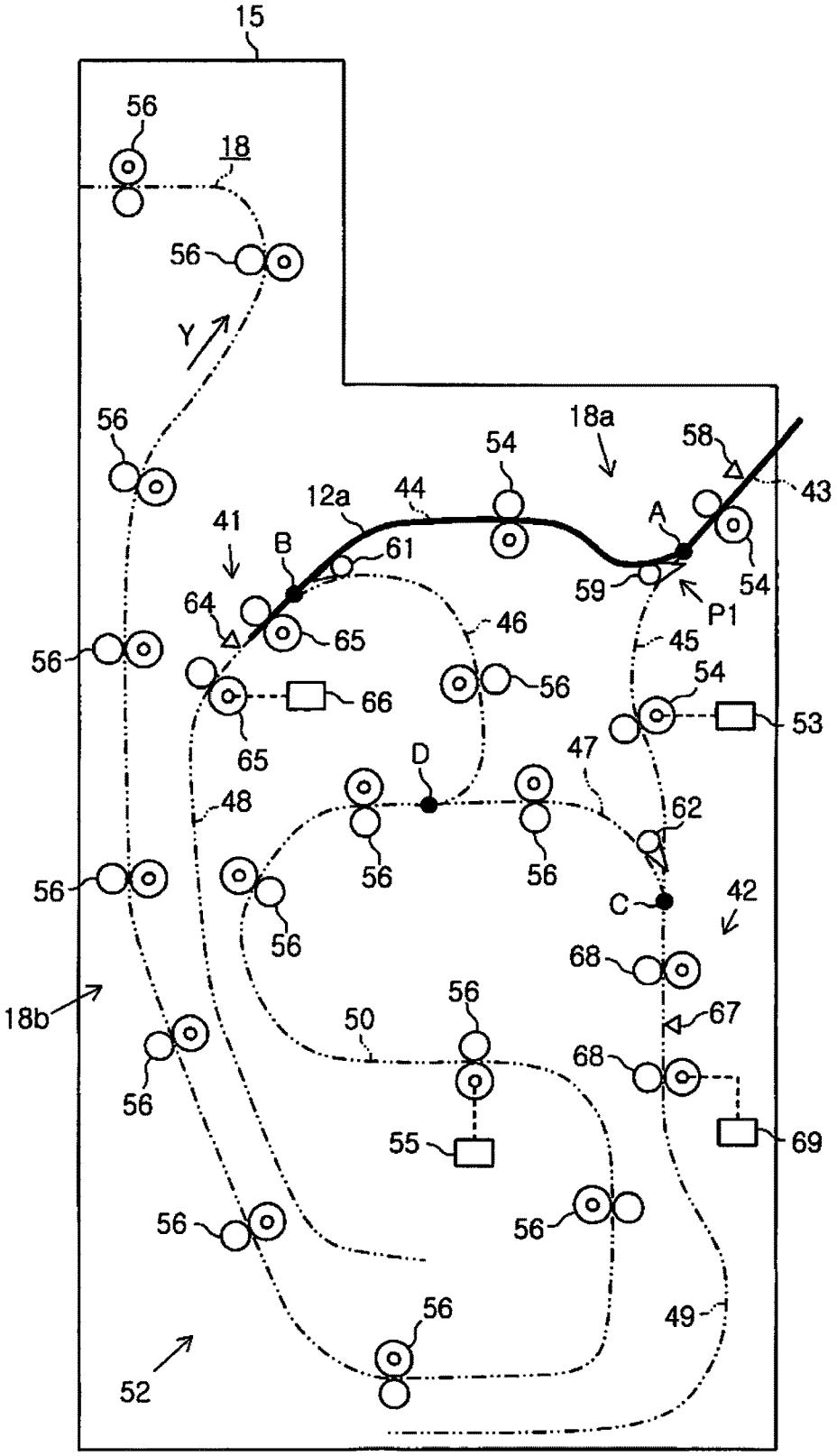
FIG. 4 is a schematic diagram of the intermediate device that transports the first medium.

As described in FIG. 4, the first medium 12*a* transported at the pre-inversion speed along the upstream side transport path 17 is received to the introduction path 43 at approximately the same speed. When the introduction sensor 58 detects a leading end of the first medium 12*a*, the control unit 71 positions the guide flap 59 at the first position P1 by driving the solenoid 60. That is, the guide flap 59 guides the first medium 12*a* to the first branch path 44. The leading end of the first medium 12*a* transported up to the first connection point B is brought into contact with the first regulation flap 61 such that the first regulation flap 61 is moved against the bias force of the bias member. That is, the first regulation flap 61 is moved to open the downstream end of the first branch path 44. Therefore, the first medium 12*a* is fed at the pre-inversion speed along the first switchback path 48 by the first inversion roller pair 65 driven in the rotation state. When the first medium 12*a* passes through the first regulation flap 61, the first regulation flap 61 is moved from a position at which the downstream end of the first branch path 44 is open to a position at which the downstream end is close.

Figure 5:
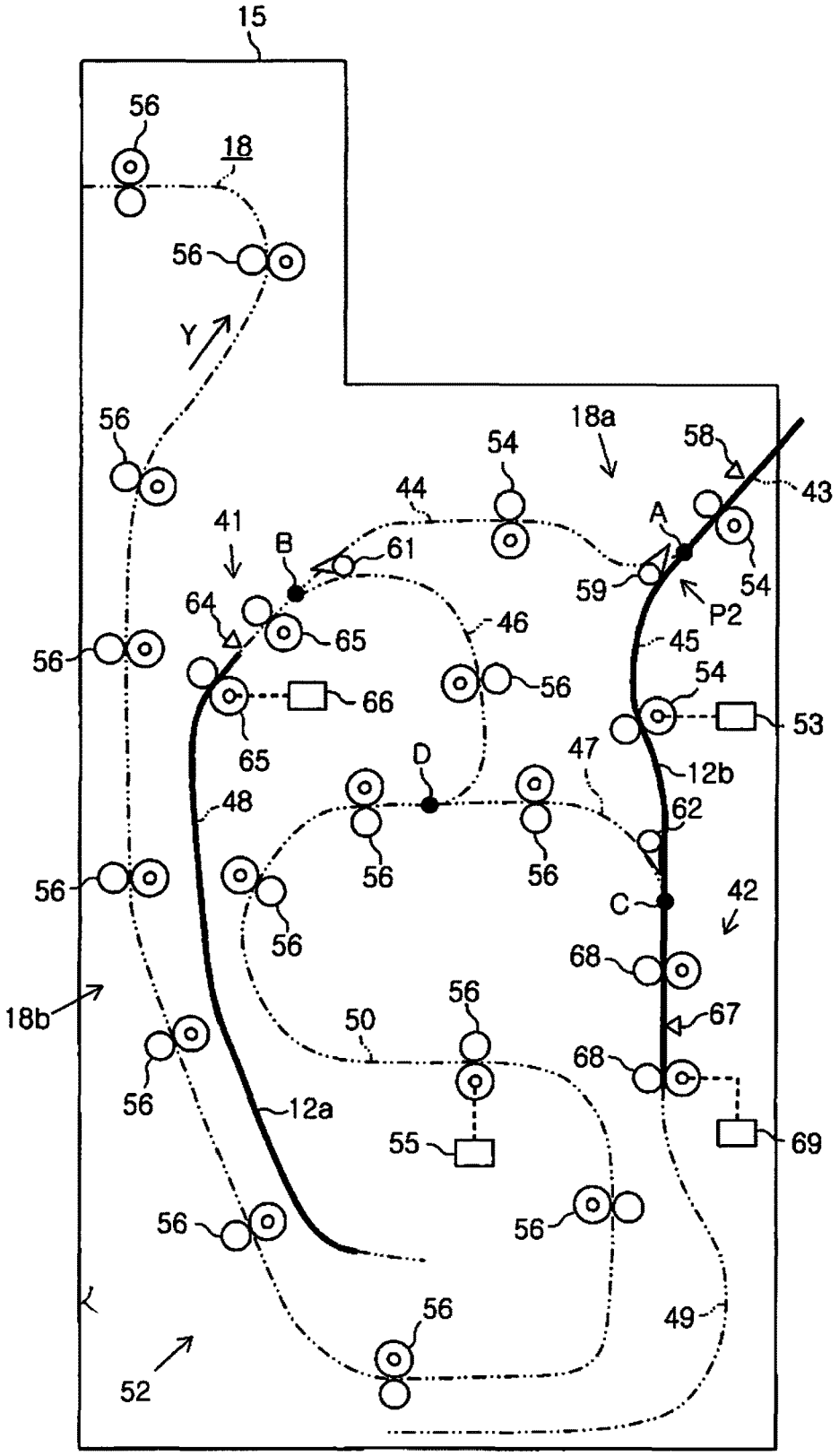
FIG. 5 is a schematic diagram of the intermediate device that transports the first and second media.

As described in FIG. 5, when the first inversion sensor 64 detects a trailing end of the first medium 12*a*, the control unit 71 switches the first inversion motor 66 driven in the rotation state to the counter-rotation state. The first inversion unit 41 sends the first medium 12*a* from the first switchback path 48 to a first connection point B side at the post-inversion speed. In addition, at this time, the first regulation flap 61 guides the first medium 12*a* to the first inversion path 46. That is, the first inversion unit 41 sends the first medium 12*a* fed from the first branch path 44 to the first inversion path 46 such that a direction of the first medium 12*a* is inverted (switchback).

In addition, when the introduction sensor 58 detects a leading end of the second medium 12*b*, the control unit 71 changes a position of the guide flap 59 by driving the solenoid 60. That is, the control unit 71 moves the guide flap 59 positioned at the first position P1 to the second position P2. The guide flap 59 guides the second medium 12*b* to the second branch path 45.

Figure 6:
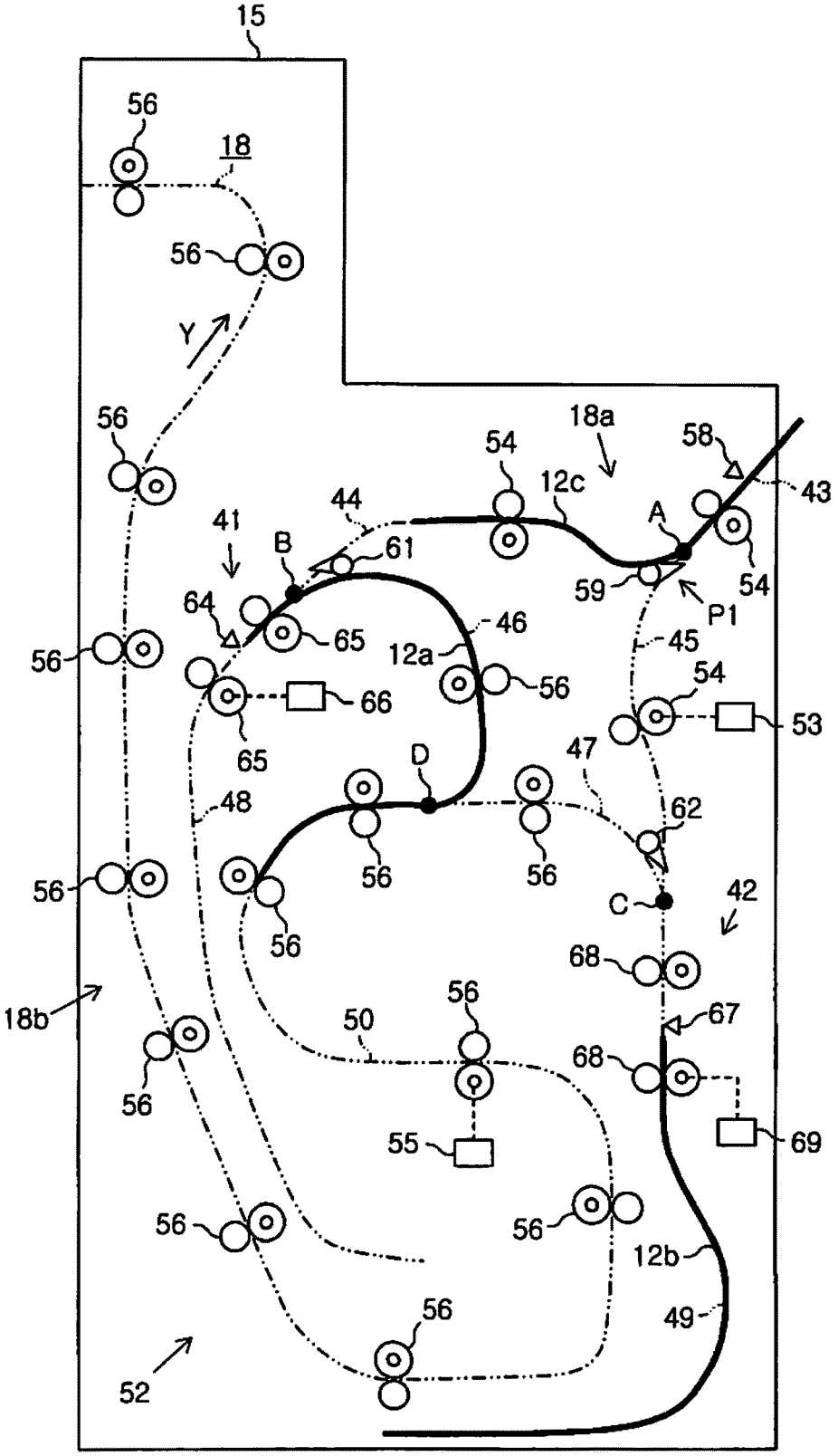
FIG. 6 is a schematic diagram of the intermediate device that transports the first to third media.

As described in FIG. 6, the first medium 12*a* inverted by the first inversion unit 41 is transported along the post-inversion path 18*b* at the post-inversion speed. When the first medium 12*a* passes through the first connection point B, the control unit 71 drives the first inversion motor 66 in the rotation state. In addition, when the second inversion sensor 67 detects a trailing end of the second medium 12*b*, the control unit 71 drives the second inversion motor 69 in the counter-rotation state. That is, the second inversion unit 42 inverts the second medium 12*b* and sends the inverted second medium 12*b* along the second inversion path 47 at the post-inversion speed, similar to the first inversion unit 41.

It is preferable that the post-inversion speed at which the first inversion unit 41 sends the first medium 12*a* from the first switchback path 48 to the first connection point B side, and the post-inversion speed at which the second inversion unit 42 sends the second medium 12*b* from the second switchback path 49 to the second connection point C side be the same as each other. According to this configuration, in the transporting after each medium is inverted, it is possible to maintain an interval between a trailing end of the preceding medium and a leading end of the subsequent medium at a constant.

Furthermore, when the introduction sensor 58 detects a leading end of the third medium 12*c*, the control unit 71 changes a position of the guide flap 59 by driving the solenoid 60. That is, the control unit 71 moves the guide flap 59 positioned at the second position P2 to the first position P1. That is, the guide flap 59 alternately guides the transported medium 12 to the first branch path 44 and the second branch path 45.

Figure 7:
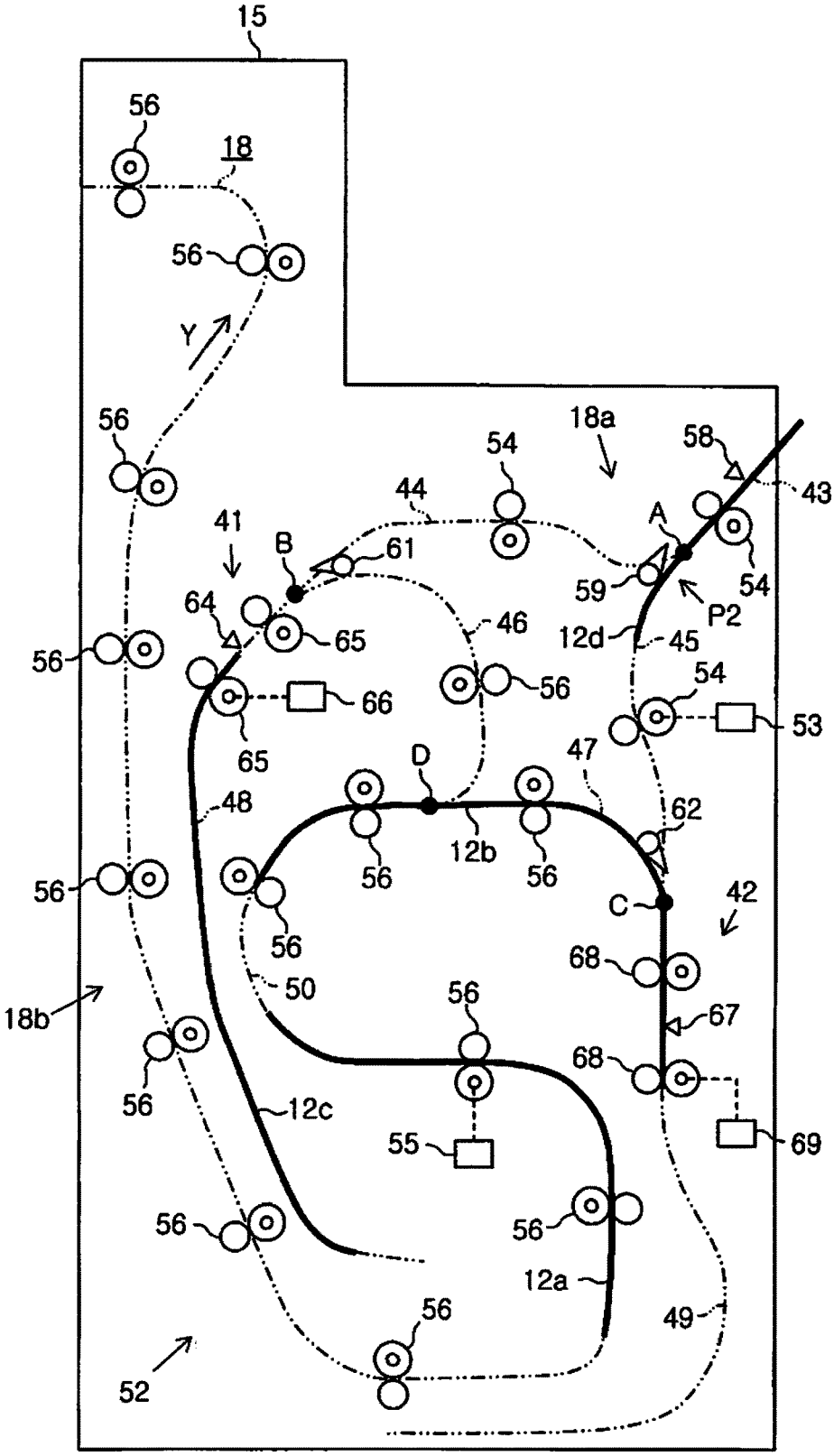
FIG. 7 is a schematic diagram of the intermediate device that transports the first to fourth media.

As described in FIG. 7, the second medium 12*b* inverted in the second inversion unit 42 and sent to the second inversion path 47 is transported along the derivation path 50 through the join point D. At this time, the intermediate transport unit 52 transports the first medium 12*a* and the second medium 12*b* at the post-inversion speed slower than the pre-inversion speed. Therefore, intervals between the first medium 12*a* and the second medium 12*b* in the transport direction Y are smaller than those of a case where transporting along the pre-inversion path 18*a* at the pre-inversion speed.

When the first inversion sensor 64 detects a trailing end of the third medium 12*c*, the control unit 71 drives the first inversion motor 66 in the counter-rotation state, and sends the third medium 12*c* to the first inversion path 46. In addition, when the introduction sensor 58 detects a leading end of the fourth medium 12*d*, the control unit 71 drives the solenoid 60, and changes a position of the guide flap 59 to the second position P2.

The intermediate device 15 sequentially sends the media 12 from the first medium 12*a* that is received in advance to the post-processing device 14. That is, the medium 12 is sent to the post-processing device 14 in a state where the printed front surface faces a gravity direction. In addition, since the downstream side transport unit 35 transports the medium 12 at the processing speed faster than the post-inversion speed, intervals between the media 12 become larger. The post-processing unit 36 performs a process such as stapling on the media 12 transported along the downstream side transport path 19, and discharges the processed media to the discharge unit 37.

In the device main body 13, an interval between a trailing end of the preceding medium 12 and a leading end of the subsequent medium 12 is set as an interval A. In addition, after the preceding medium 12 and the subsequent medium 12 are switched back in the intermediate device 15, an interval between the trailing end of the preceding medium 12 and the leading end of the subsequent medium 12 is set as an interval B. In addition, when the trailing end of the preceding medium 12 passes through the downstream side transport roller pair 39 of the post-processing device 14, the interval between the trailing end of the preceding medium 12 and the leading end of the subsequent medium 12 is set as an interval C.

At this time, in each interval, the following inequalities are satisfied.

$$\text{interval } A > \text{interval } C > \text{interval } B, \qquad \text{Inequality 1: or}$$

$$\text{interval } C > \text{interval } A > \text{interval } B \qquad \text{Inequality 2:}$$

A relationship of magnitude between the interval A and the interval C can be appropriately adopted based on the transport path of the apparatus. For example, in a case where it is necessary to sufficiently ensure the intervals between the media 12 in the device main body 13, it is preferable that Inequality 1 be adopted. Meanwhile, in a case where a post-processing in the post-processing unit 36 of the post-processing device 14 is not sufficiently performed in the interval A, Inequality 2 may be adopted. Alternatively, if there are no problems in various processes in the apparatus, the interval A and the interval C may be the same.

Even in any case, the interval B becomes smaller than the interval A and the interval C. With this, in the intermediate device 15, since intervals between the media 12 can be decreased and the media can be transported at a speed slower than the transport speed before the switchback is performed, it is possible to ensure a time required for drying the medium 12 in the intermediate device 15.

By the way, in order to make the interval C larger than the interval B, the transport speed of the downstream side transport roller pair 39 may be faster than the transport speed of the transport roller pair (for example, second transport roller pair) of the intermediate device 15. In this case, if a friction clutch or the like is provided in the transport roller pair of the intermediate device 15, even in a situation in which a leading end of the medium 12 is nipped by the downstream side transport roller pair 39 such that the transport starts, since it is possible to reduce occurrence of back tension due to a portion of the medium 12 nipped by the transport roller pair of the intermediate device 15, disturbance of the transport does not occur.

A rotation speed of the downstream side transport roller pair 39 is faster than the rotation speed of the transport roller pair of the intermediate device 15. Accordingly, the interval C is changed by a size of the transported medium 12 in a transport direction. That is, when the medium 12 is transported to be a long side of the medium 12 in parallel with the transport direction, in a case where A3 is transported and a case where A4 is transported, since a time accelerated by the downstream side transport roller pair 39 in the case of A3 increases, the interval C in the case where A3 is transported is larger than that of the case where A4 is transported.

In this manner, according to the size the medium 12, as the size increases in the transport direction, when the process of stapling a plurality of the media 12 with a stapler (pin) in the post-processing unit 36 or the like is performed, the reason why difference between intervals of the interval C is necessary is that lots of times required to align end portions of the plurality of the media 12 are required. That is, since a surface area of the medium 12 of A3 is increased compared to A4, a large amount of time is required for stapling the end portions that are processing portions due to the friction between the plural sheets of the media 12.

There is another regulation method for the interval A, the interval B, and the interval C. That is, for the interval A, it is possible to consider a difference time from a time in which the trailing end of the preceding medium 12 reaches, to a time in which a trailing end of the subsequent medium 12 reaches, as the interval A, with respect to the upstream side transport roller pair 30 of the device main body 13. In addition, for the interval B, after the preceding medium 12 and the subsequent medium 12 are switched back at the same time, it is possible to consider the difference time from the time in which the trailing end of the preceding medium 12 reaches, to the time in which the trailing end of the subsequent medium 12 reaches, as the interval B, with respect to the join point D on the intermediate transport path 18. In addition, for the interval C, it is possible to consider the difference time from the time during which the trailing end of the preceding medium 12 reaches, to the time during which the trailing end of the subsequent medium 12 reaches, as the interval C, with respect to the downstream side transport roller pair 39 of the post-processing device 14.

Besides, it is considered that there are various positions as a position to be a reference of intervals between the preceding medium 12 and the subsequent medium 12. That is, for the interval A, the difference time from the time during which the trailing end of the preceding medium 12 reaches, to the time during which the trailing end of the subsequent medium 12 reaches, may be considered as the interval A with respect to the introduction sensor 58 positioned in the vicinity of a branch point A on the intermediate transport path 18. In addition, for the interval B, a difference time from a time during which the trailing end of the preceding medium 12 reaches with respect to the first inversion sensor 64 of the first switchback path 48, to a time during which the trailing end of the subsequent medium 12 reaches with respect to the second inversion sensor 67 of the second switchback path 49, may be considered as the interval B. That is, the first switchback path 48 and the second switchback path 49 are paths for separately performing switchback on the preceding medium 12 and the subsequent medium 12 branched and transported from the branch point A, in a viewpoint of improving transport efficiency. Therefore, as a design concept of the intermediate transport path 18, the first switchback path 48 and the second switchback path 49 are designed to be the same transport distance. In this manner, even if the preceding medium 12 and the subsequent medium 12 are branched and transported in different switchback paths, it is possible to appropriately manage the intervals between the preceding medium 12 and the subsequent medium 12 after the switchback is performed. Therefore, according to the transport path based on such a design concept, a reference position of the interval B may be different positions by using the first inversion sensor 64 and the second inversion sensor 67.

In the above description, at positions to be the reference of each interval, a time until the trailing end of the preceding medium 12 and the trailing end of the subsequent medium 12 pass through may be the interval. Instead of this, at positions to be the reference of each interval, a time until a leading end of the preceding medium 12 and a leading end of the subsequent medium 12 pass through may be the interval.

By the way, a start point and an end point of physical intervals between the media 12 are different from each other before and after the switchback is performed on the first switchback path 48 or the second switchback path 49. That is, if before the switchback is performed, an interval is between the trailing end of the preceding medium 12 and the leading end of the subsequent medium 12. Meanwhile, if after the switchback is performed, the interval is between the trailing end of the preceding medium 12 after the switchback is performed and the leading end of the subsequent medium 12 after the switchback is performed. Furthermore, if the preceding medium 12 is at a timing after the switchback is performed and the subsequent medium 12 is at a timing before the switchback is performed, the interval between the media 12 is an interval between the trailing end of the preceding medium 12 after the switchback is performed and the leading end of the subsequent medium 12 after the switchback is performed.

According to the embodiments, the following effect can be obtained.

(1) The intermediate transport unit 52 transports the medium 12 before being inverted at the pre-inversion speed, and transports the medium 12 after being inverted in the first inversion unit 41 or the second inversion unit 42 at the post-inversion speed slower than the pre-inversion speed. Therefore, a time required for transporting along the post-inversion path 18*b* can be longer than a time required for transporting along the post-inversion path 18*b* at the pre-inversion speed. Accordingly, it is possible to ensure a required transport time while suppressing an increase in the size of the device.

(2) In the post-processing unit 36 performing a process on the medium 12, for example, when intervals between the plurality of media 12 to be transported decrease, there is a possibility that the next medium 12 is transported before completing processing on the medium 12 that is transported in advance and erroneous processing is performed. Accordingly, the downstream side transport unit 35 transports the medium 12 at the processing speed faster than the post-inversion speed along the downstream side transport path 19. Therefore, even in a case where the intervals between the media 12 decrease in the course of being transported along the post-inversion path 18*b*, it is possible to increase the intervals between the media 12.

(3) As the unit adhesion amount increases, the required transport time increases. Furthermore, as the transport speed of the medium 12 decreases, the intervals between the media 12 decrease. Accordingly, the interval between the media 12 at the time of feeding is changed according to the unit adhesion amount. Therefore, even in a case where the unit adhesion amount is high, it is possible to transport the medium 12 at a sufficiently slow transport speed while suppressing the occurrence of contamination or the like due to overlapping of the media 12.

(4) In a case where the medium 12 having a high unit adhesion amount and a large transport time is transported, the downstream side transport unit 35 transports the medium 12 at the second post-inversion speed slower than the first post-inversion speed along the post-inversion path 18*b*. Therefore, it is possible to further increase a time required for transporting the medium along the post-inversion path 18*b*, compared to a case where the medium 12 is transported at the first post-inversion speed.

(5) Since the print apparatus 11 includes the device main body 13, the post-processing device 14, and the intermediate device 15, it is possible to easily change a combination of the apparatus. Therefore, for example, by exchanging the post-processing device 14, it is possible to easily change processing performed on the medium 12 by the post-processing unit 36.

(6) The medium 12 is dried while the medium is transported by the transport unit. Therefore, by lengthening the transport time according to the transport of the medium at the post-inversion speed slower than the pre-inversion path 18*a* along the post-inversion path 18*b*, even if, for example, the curling occurs on the medium 12 according to printing, it is possible to discharge the medium 12 in a state where the curling is reduced. Accordingly, it is possible to reduce occurrence of media clogging and process failure generated in a case where, for example, the medium 12 in which the curling occurs, processed in the post-processing unit 36.

(7) By changing the intervals between the media 12 and the post-inversion speed when the feeding unit 22 feeds the medium 12 according to the unit adhesion amount, it is possible to reduce the overlapping of the media 12. Accordingly, it is possible to reduce the occurrence of the media clogging due to contact between the media 12.

The embodiment may be modified as follows.

In the embodiment, the inversion unit may be provided equal to or greater than three.

In the embodiment, a motor for driving the second transport roller pair 56 positioned on the most downstream side in the transport direction Y may be provided separately. That is, a speed for sending the medium 12 from the post-inversion path 18*b* to the downstream side transport path 19 may be different from the post-inversion speed. For example, the intermediate transport unit 52 may send the medium 12 along the post-inversion path 18*b* at a feeding speed (example of fifth transport speed) faster than the first post-inversion speed (first modification example). It is preferable that the feeding speed be faster than the first post-inversion speed and the same as the processing speed or slower than the processing speed (processing speed≥ feeding speed≥ the pre-inversion speed>first post-inversion speed>second post-inversion speed).

According to a first modification example, the medium 12 is transported at the first post-inversion speed along the post-inversion path 18*b*, and sent from the post-inversion path 18*b* at the feeding speed faster than the first post-inversion speed. Therefore, for example, even in a case where the media 12 overlap each other at the time of transporting along the post-inversion path 18*b*, it is possible to send the media along the post-inversion path 18*b* by separating the media 12 from each other. That is, the media 12 are separated from each other such that it is possible to transfer the separated media to the downstream side transport path 19.

In the embodiment, the intermediate transport unit 52 may transport the media along the post-inversion path 18*b* in a state where a part of the media 12 overlap each other. At this time, it is preferable that the overlapped portion be a margin that is not printed thereon. In a case where the medium 12 of the downstream side in the transport direction Y is drawn out by the downstream side transport unit 35 in a state where the overlapped portion is interposed between the second transport roller pair 56, the driving roller and the driven roller constituting the second transport roller pair 56 are separated from each other.

In the embodiment, the transport speed of the medium 12 on the upstream side transport path 17 and the pre-inversion path 18*a* may be different from each other. For example, the upstream side transport unit 23 may transport the medium 12 along the upstream side transport path 17 at a print speed slower than or faster than the pre-inversion speed.

In the embodiment, the rollers on different paths may be driven by one motor. For example, the upstream side transport roller pair 30 may be driven by the first transport motor 53 without using the upstream side transport motor 29.

In the embodiment, the threshold value relating to the unit adhesion amount stored in the storage unit 73 may be set or selected according to an environment in which the print apparatus 11 is installed. That is, the curling that occurs in the printed medium 12 depends on an environment. Specifically, for example, in a low humidity environment, since an amount of moisture contained in the medium 12 before printing is small, it is likely that the curling accompanying the printing increases. In addition, in a low temperature, since fluidity of the liquid decreases and the liquid is difficult to evaporate, a time for reducing the curling is required. Accordingly, in an environment where it is difficult to reduce the curling, the threshold value may decrease.

In the embodiment, a plurality of the threshold values relating to the unit adhesion amount may be set, and the intervals between the medium 12 fed by the feeding unit 22 and the post-inversion speed may be changed step by step.

In the embodiment, the medium 12 may be transported along the post-inversion path 18*b* at the post-inversion speed (second transport speed) slower than the pre-inversion speed (first transport speed) regardless of the unit adhesion amount. That is, the second post-inversion speed may be not set.

In the embodiment, the feeding unit 22 may feed the media 12 with the first interval by rotating the pickup roller 26 at a first rotation speed, and may feed the media 12 with the second interval larger than the first interval by rotating at a second rotation speed slower than the first rotation speed.

In the embodiment, the feeding unit 22 may feed the medium 12 with a constant interval regardless of the unit adhesion amount.

In the embodiment, the print apparatus 11 may not include the feeding unit 22. For example, the print apparatus 11 may include a feeding outlet, and the upstream side transport unit 23 may transport the medium 12 inserted one at a time from the feeding outlet. That is, the print apparatus 11 may perform printing on the medium 12 fed from a feeding device provided separately from the print apparatus 11. In addition, the feeding unit 22 may feed the medium 12 set in a feeding tray one at a time.

In the embodiment, in the post-processing unit 36, any processing such as a punching process for punching a hole in the medium 12, a shifting process for discharging the medium 12 by shifting it by unit basis, a cutting process for cutting the medium 12, a folding process for folding the medium 12, a bookbinding process for binding the medium 12, or a collating processing, may be performed.

In the embodiment, the print apparatus 11 may be a configuration in which the post-processing device 14 is not included.

Liquid can be arbitrarily selected if the liquid can be printed on the medium 12 by adhering the liquid to the medium 12. The liquid may be in a state when the material is in a liquid phase, and may include a liquid material such as a liquid material having high or low viscosity, sol, gel water, other inorganic solvent, organic solvent, solution, liquid resin, and liquid metal (metallic melt). In addition, not only liquid as one state of a material but also a material in which particles of a functional material composed of solid matter such as a pigment or metal particles is dissolved, dispersed or mixed by a solvent, and the like are included. As a representative example of the liquid, there is ink. The ink includes various kinds of liquid compositions such as general water-based ink, oil-based ink, gel ink, and hot melt ink.

The medium 12 may be papers, resins, metals, clothes, ceramics, rubbers, natural materials (wood, stone, and the like), or a composite thereof. A thickness of the medium may be as a plate, a sheet, a film, a foil, or the like. Furthermore, a shape of the medium may be any shape such as a rectangle and a circle. That is, for example, a composite film of papers and resins (resin impregnated paper, resin coated paper, and the like), a composite film of resins and metals (laminate film), woven fabrics, non-woven fabrics, disk, circuit boards, and the like may be used. In a case of a medium which swells by adhering liquid such as papers, it is possible to reduce the curling while being transported along the intermediate transport path 18. In addition, in a case of a medium which does not swell, it is possible to dry the medium while being transported along the intermediate transport path 18 although the curling does not occur. Accordingly, it is possible to appropriately process the medium 12 transported along the intermediate transport path 18 in the post-processing unit 36.

The print apparatus 11 is an apparatus that prints images such as letters, pictures, and photographs by adhering liquid such as the ink to a medium, and may also be as a serial printer, a lateral type printer, a line printer, a page printer, or the like. In addition, the print apparatus may be as an offset print apparatus, and a textile print apparatus. In addition, the print apparatus may have at least a print function of printing on a medium, and may also be a multifunction peripheral having functions other than the print function.

What is claimed is:

1. A medium transporting mechanism comprising:

an upstream route configured to transport a medium that has been recorded by a recording head that discharges droplets;

a switchback route configured to switch back the medium transported from the upstream route;

a guide route configured to transport the medium from the upstream route to the switchback route;

an upstream reversing route configured to reverse and transport the medium switched back from the switchback route;

a downstream reversing route configured to reverse and transport the medium transported from the upstream reversing route, wherein the upstream reversing route is joined on the downstream reversing route, wherein the downstream reversing route is connected to a downstream route configured to transport the medium to a post-processing unit, wherein a second transport speed that is a transport speed of the medium on the downstream reversing route, is slower than a first transport speed that is the transport speed of the medium on the guide route, and wherein a distance between a trailing end of a preceding medium and a leading end of a subsequent medium following the preceding medium in the downstream reversing route is smaller than a distance between a trailing end of a preceding medium and a leading end of a subsequent medium following the preceding medium in the upstream route.

2. The medium transporting mechanism according to claim 1, wherein the switchback route extends in a first direction, and wherein the downstream reversing route extends in the first direction and then extends in a second direction opposite to the first direction by going around the leading end of the switchback route.

3. The medium transporting mechanism according to claim 1, further comprising:

a transport control unit configured to control transporting of the medium, the transport control unit being configured to control the transporting to cause a first interval as an interval between the preceding medium and the subsequent medium before recording on the medium, in a case where the unit adhesion amount, which is an amount of liquid which is caused by a printing unit to adhere to the medium per unit area of the medium, is less than a threshold value set in advance, control the transporting to cause a second interval larger than the first interval as the interval between the preceding medium and the subsequent medium before recording on the medium, in a case where the unit adhesion amount is greater than the threshold value, control the transport speed, in the downstream reversing route, to be the second transport speed in a case where the interval between the preceding medium and the subsequent medium is the first interval, and control the transport speed, in the downstream reversing route, to be a fourth transport speed slower than the second transport speed in a case where the interval between the preceding medium and the subsequent medium is the second interval.

4. The medium transporting mechanism according to claim 3, wherein the transport control unit is configured to control the transport speed of the medium, in the downstream reversing route, to be a third transport speed faster than the second transport speed on the downstream route.

5. The medium transporting mechanism according to claim 4, wherein the transport control unit is configured to control the transporting to cause an interval after which each of the media is switched back, the interval being smaller than an interval before which each of the media is switched back, as the interval between the preceding medium and the subsequent medium, and control the transporting to cause an interval larger than the interval after awhich the media is switched back when the preceding medium is transported at the third transport speed.

6. A medium transporting mechanism comprising:

an upstream route configured to transport a medium that has been recorded by a recording head that discharges droplets;

a first switchback route configured to switch back the medium transported from the upstream route;

a second switchback route configured to switch back the medium transported from the upstream route;

a first guide route configured to transport the medium from the upstream route to the first switchback route;

a second guide route configured to transport the medium from the upstream route to the second switchback route;

a first upstream reversing route configured to reverse and transport the medium switched back from the first switchback route;

a second upstream reversing route configured to reverse and transport the medium switched back from the second switchback route; and a downstream reversing route configured to reverse and transport the medium transported from the first upstream reversing route or the second upstream reversing route, wherein the first upstream reversing route and the second upstream reversing route are joined on the downstream reversing route, wherein the downstream reversing route is connected to a downstream route configured to transport the medium to a post-processing unit, wherein a second transport speed that is a transport speed of the medium on the downstream reversing route, is slower than a first transport speed that is the transport speed of the medium on the first guide route or the second guide route, and wherein a distance between a trailing end of a preceding medium and a leading end of a subsequent medium following the preceding medium in the downstream reversing route is smaller than a distance between a trailing end of a preceding medium and a leading end of a subsequent medium following the preceding medium in the upstream route.

7. The medium transporting mechanism according to claim 6, further comprising:

a transport control unit configured to control transporting of the medium, the transport control unit being configured to control the transporting to cause a first interval as an interval between the preceding medium and the subsequent medium before recording on the medium, in a case where the unit adhesion amount, which is an amount of liquid which is caused by a printing unit to adhere to the medium per unit area of the medium, is less than a threshold value set in advance, control the transporting to cause a second interval larger than the first interval as the interval between the preceding medium and the subsequent medium before recording on the medium, in a case where the unit adhesion amount is greater than the threshold value, control the transport speed, in the downstream reversing route, to be the second transport speed in a case where the interval between the preceding medium and the subsequent medium is the first interval, and control the transport speed, in the downstream reversing route, to be a fourth transport speed slower than the second transport speed in a case where the interval between the preceding medium and the subsequent medium is the second interval.

8. The medium transporting mechanism according to claim 7, wherein the transport control unit is configured to control the transport speed of the medium, in the downstream reversing route, to be a third transport speed faster than the second transport speed on the downstream route.

9. The medium transporting mechanism according to claim 8, wherein the transport control unit is configured to control the transporting to cause an interval after which each of the media is switched back, the interval being smaller than an interval before which each of the media is switched back, as the interval between the preceding medium and the subsequent medium, and control the transporting to cause an interval larger than the interval after which the media is switched back when the preceding medium is transported at the third transport speed.

* * * * *